US005901723A

United States Patent [19]

Ames

[11] Patent Number: 5,901,723

[45] Date of Patent: May 11, 1999

[54] SECURITY CANE WITH PEPPER SPRAY DISPENSER

[76] Inventor: Russell R. Ames, 7643 Shadow Hill La., Cupertino, Calif. 95014

[21] Appl. No.: 08/820,933

[22] Filed: Mar. 19, 1997

[51] Int. Cl.[6] ..... A45B 3/00

[52] U.S. Cl. ..... 135/66; 135/70; 135/77; 135/83; 222/79; 222/192; 362/96; 362/102

[58] Field of Search ..... 135/66, 65, 70, 135/77, 83, 19.5, 17; 362/102, 96; 222/113, 192, 79, 402.11; 239/578, 532, 525, 526, 528

[56] References Cited

U.S. PATENT DOCUMENTS

| | | | |
|---|---|---|---|
| D. 278,387 | 4/1985 | Bixler | D3/7 |
| 2,438,014 | 3/1948 | Lukowitz | 135/66 |
| 3,038,483 | 6/1962 | Altsheler | 222/79 X |
| 4,314,575 | 2/1982 | Kuo | 135/66 |
| 4,446,990 | 5/1984 | Stevenson et al. | 222/82 |
| 4,562,850 | 1/1986 | Earley et al. | 135/66 |
| 4,583,080 | 4/1986 | DiVito et al. | 340/407 |
| 4,625,742 | 12/1986 | Phillips | 135/66 |
| 4,837,666 | 6/1989 | Conkle | 362/102 |
| 5,041,951 | 8/1991 | Fan | 362/102 |
| 5,056,545 | 10/1991 | Spaeth | 135/66 |
| 5,065,904 | 11/1991 | McCaffrey et al. | 135/19.5 X |
| 5,078,322 | 1/1992 | Torntore | 239/527 X |
| 5,086,377 | 2/1992 | Roberts | 362/102 |
| 5,197,501 | 3/1993 | Ragatz | 135/66 |
| 5,219,402 | 6/1993 | Kondo et al. | 135/66 |
| 5,331,990 | 7/1994 | Hall et al. | 135/65 |
| 5,332,119 | 7/1994 | Davis | 222/78 |
| 5,339,853 | 8/1994 | Sokolis et al. | 135/67 |
| 5,351,704 | 10/1994 | Hunnicutt et al. | 135/66 |
| 5,363,285 | 11/1994 | Wideman | 362/102 |
| 5,373,427 | 12/1994 | McLean | 362/96 |
| 5,392,800 | 2/1995 | Sergi | 135/65 |
| 5,405,134 | 4/1995 | Wolfram | 273/84 |
| 5,420,766 | 5/1995 | Hollis | 362/96 |
| 5,428,514 | 6/1995 | Fink | 362/183 |
| 5,429,301 | 7/1995 | Franks | 239/1 |
| 5,446,985 | 9/1995 | Chen | 42/1.08 |
| 5,556,003 | 9/1996 | Johnson et al. | 362/102 X |

*Primary Examiner*—Carl D. Friedman
*Assistant Examiner*—Winnie S. Yip
*Attorney, Agent, or Firm*—Heller Ehrman White & McAuliffe; Jacques M. Dulin

[57] ABSTRACT

Pepper spray canister is mounted in the tubular bore of a cane or walker leg or handle, and is actuable by a trigger mounted adjacent, or in, the handle after release of a safety interlock. Several embodiments are shown, both with the canister in the handle or remote therefrom, and wherein the spray can exit the base (tip) of the cane leg or adjacent the handle. One embodiment comprises a trigger interlock button sleeve mountable at the top of the leg with the canister, actuable by a rod passing down the leg, located adjacent the lower end of the leg. Other embodiments include a straight, T-shaped or L-shaped handle which houses the canister. Several trigger mechanisms are shown: first at the rear juncture of the handle and leg; at the forward juncture thereof; or on the forward top surface of the handle.

20 Claims, 7 Drawing Sheets

SECURITY CANE WITH PEPPER SPRAY DISPENSER

TECHNICAL FIELD

This invention relates to security devices, and more particularly to a cane for aged or infirm individuals having contained therein a miniature pepper spray container (or other self-defense spray) and a trigger mechanism which permits the spray to exit for security purposes, either at the tip or base of the cane, or adjacent the upper handle. A variety of embodiments are shown, including safety interlocks.

BACKGROUND OF THE PRIOR ART

A variety of security devices are currently available or have been proposed to ward off human or animal attackers, such as muggers, dogs, and the like. These include a variety of hand-held pepper spray or Mace devices, and such sprays contained within and/or disguised by other equipment, such as training weights, batons, flashlights, and pagers: U.S. Pat. Nos. 5,332,119 (training weights plus self-defense spray); 5,373,427 (flashlight plus self defense spray); 5,405,134 (baton handle for self-defense spray attachable to a flashlight); 5,086,377 (baton with spray canister); and 5,429, 301 (self-defense spray disguised as a pager). No self-defense sprays are shown with canes, crutches or walkers. Other types of devices include sonic alarms and Taser-type devices which immobilize an attacker with high voltage electricity.

In addition, canes, crutches and walkers have been adapted for a variety of safety and aid devices, such as alarms and lights, including U.S. Patents: U.S. Pat. Nos. 5,392,800 (cane with a trigger actuated claw); 5,197,501 and 4,583,080 (canes with a light and sonic alarm); and 5,339, 853 (walker plus light).

There is a particular need for a simple and effective device for older and infirm people who rely on some sort of walking assist device, such as a cane, walker, or the like. Such devices need to be lightweight, simple and easy to manipulate, especially for people who may be older or have arthritis, or are unsteady on their feet. In addition, it is important that delivery of the pepper spray be easily directable, and deliverable at some distance from the user so that they are not themselves incapacitated by the spray.

DISCLOSURE OF INVENTION

It is among the objects and advantages of the invention to provide a self-defense spray security canister, preferably pepper spray, Mace or the like, which is mountable internally in a conventional cane, crutch, alpenstock, or walker, and which is unobtrusive, lightweight yet simple to operate and re-supply. It is another object and advantage of the invention to provide a pepper spray security cane or walker in which the pepper spray canister can be mounted in a hollow leg or handle, and actuated by a simple trigger device that does not require the user to reposition their hand. It is still another object and advantage of the invention to provide a pepper spray security cane in which the spray can be selectively directed at the attacking person or animal from more than one position, and which contains safety interlocks. Still other objects are evident from the descriptions and drawings.

The invention in a principal embodiment comprises a pepper spray canister which is mounted in the hollow leg or handle of a cane or a walker, and which is actuable by a trigger adjacent the handle. In a first embodiment, the pepper spray canister is mounted in the lower end of the leg of a cane. An actuator rod, which is activated by a trigger at the handle, extends down the inside of the tube to actuate the canister, releasing the pepper spray out a hole in the tip of the cane at the base. To use the cane, it is simply raised, pointed at the attacker and the trigger is actuated. The assembly is lightweight, simple to manufacture and easy to mount in a standard cane, as it does not involve changing the cane construction. A sleeve containing the trigger, trigger guard and lock is interposed between the upper end of the cane leg and the handle, the actuator rod is dropped down the leg of the cane, and the pepper spray canister is mountable in a special rubber tip inserted on the bottom end of the leg.

In other embodiments, a cane with a straight, T-shaped or L-shaped hollow handle is provided which contains therein both the pepper spray canister and a trigger and interlock mechanism. These embodiments are mountable on the top of a standard cane leg. The front or the rear end of the handle can be opened to provide for replenishment of the pepper spray canister.

DESCRIPTION OF DRAWINGS

The invention is illustrated in the drawings, in which:

FIG. 10A and 10B are a second embodiment of the pepper spray security cane of this invention showing a T-shaped handle assembly mountable on the top of a standard cane leg and employing a delivery tube to the cane tip, in which FIG. 10A is a side section view and FIG. 10B is a top elevation view;

FIG. 11A is a side elevation view in section of an L-shaped handle embodiment in the locked mode mounted at the top of a standard leg with a delivery tube like the second embodiment of FIGS. 10A and 10B;

FIG. 11B is a top elevation view of the embodiment of FIG. 11A;

FIG. 12 is a front elevation taken along the lines 12—12 of FIG. 11A showing the nozzle assembly;

FIG. 13 is a bottom plan view, partly in section of the third embodiment of Fig. 11C;

BEST MODE(S) FOR CARRYING OUT THE INVENTION

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

Figure 1A:
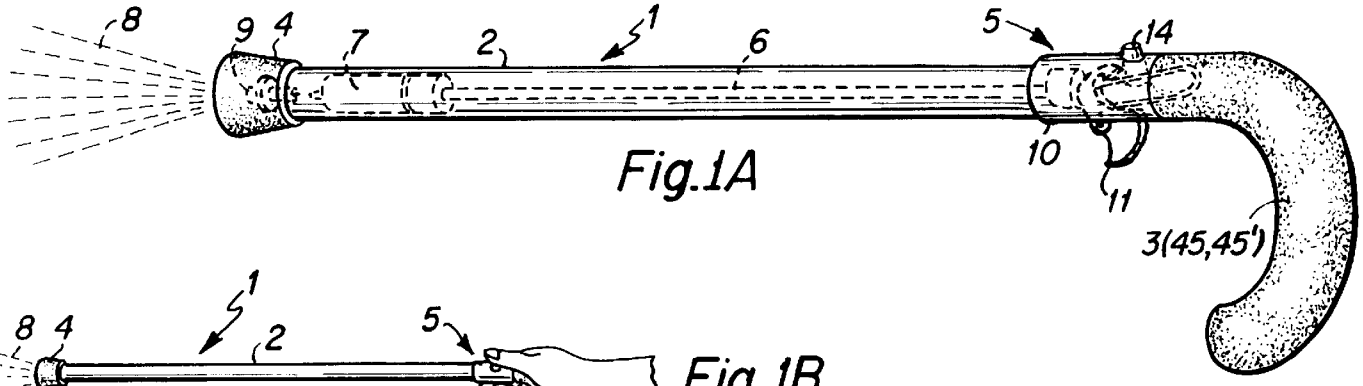
FIG. 1A is an isometric view of a first principal embodiment of the pepper spray cane of this invention showing the essential elements in phantom.
Figure 1B:
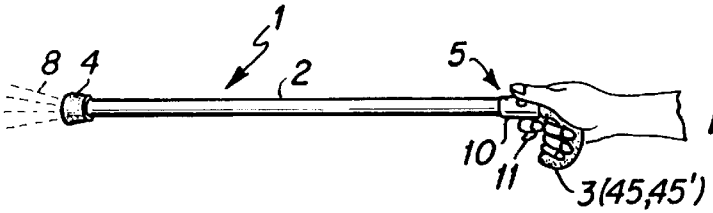
FIG. 1B is an isometric showing the use position of the pepper spray security cane of the invention of FIG. 1A.

Referring to the Figures, the overall cane assembly is shown in FIG. 1A with the use position shown in 1B. As seen in FIG. 1A, the cane assembly 1 includes a tubular shaft or leg 2, having at the top end a handle 3, and a rubber tip 4 at the lower end. A trigger assembly 5 is positioned at the juncture of the leg and the handle 3. It includes a trigger 11 which activates an actuator rod 6 that pushes down on the bottom of a standard pepper spray canister 7 located near the lower end of the cane. Alternately, the canister can be at the top with a hollow tubing extending down the leg 2 to the tip nozzle 9. This compresses the canister tip 65 releasing a spray 8 out a nozzle 9 in the rubber tip 4 of the cane. As seen in FIG. 1B, the cane 1 is simply raised, aimed at the mugger or dog, the trigger 11 is actuated and the spray 8 is released.

Figure 5:
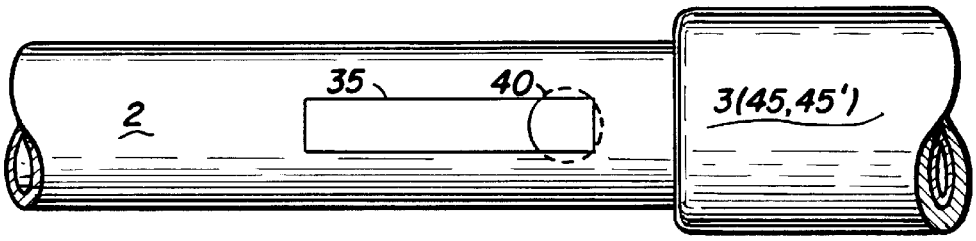
Figure 6:
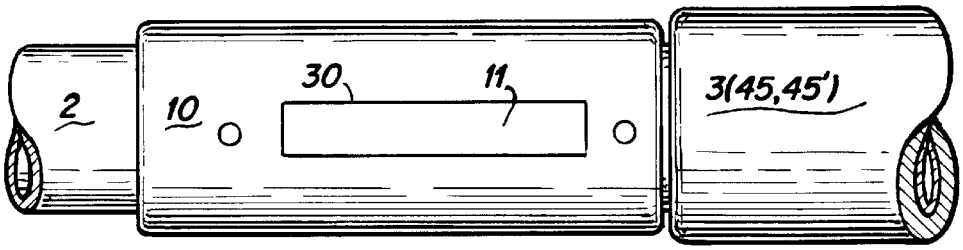
Figure 7:
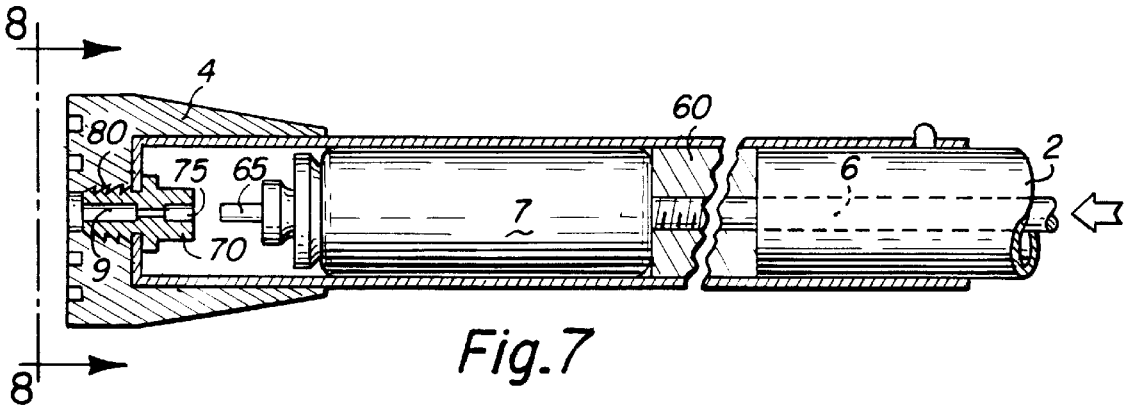
FIG. 7 is a longitudinal section view through the tip of the cane showing the actuator rod and the tip assembly for engaging the spray canister.
Figure 8:
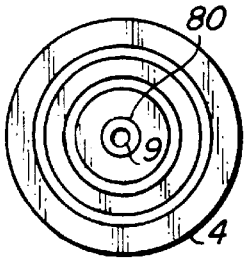
FIG. 8 is an end elevation view of the bottom tip of the cane as shown by lines 8—8 in FIG. 7.
Figure 9:
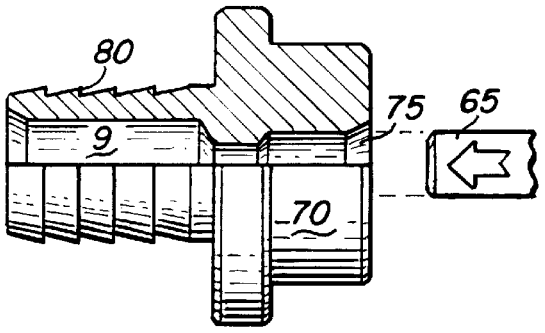
FIG. 9 is an enlarged section elevation view of the nozzle assembly that receives the tip of the spray canister and provides the outlet channel for the spray from the tip of the cane.
Figure 10A:
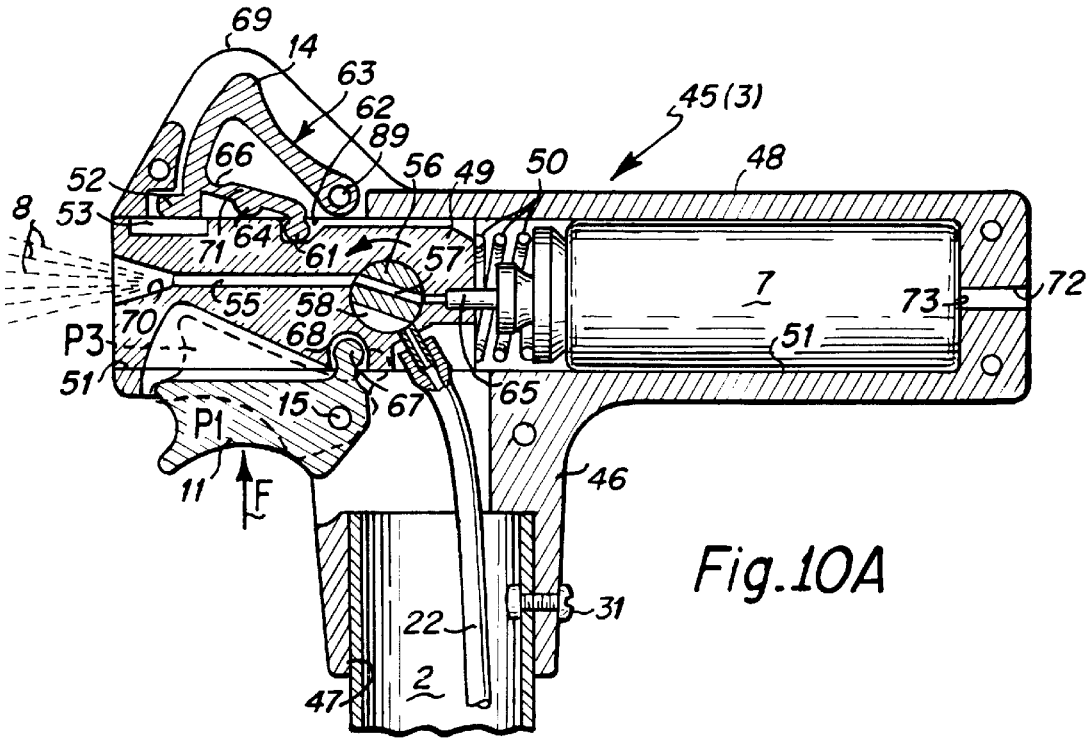
Figure 11A:
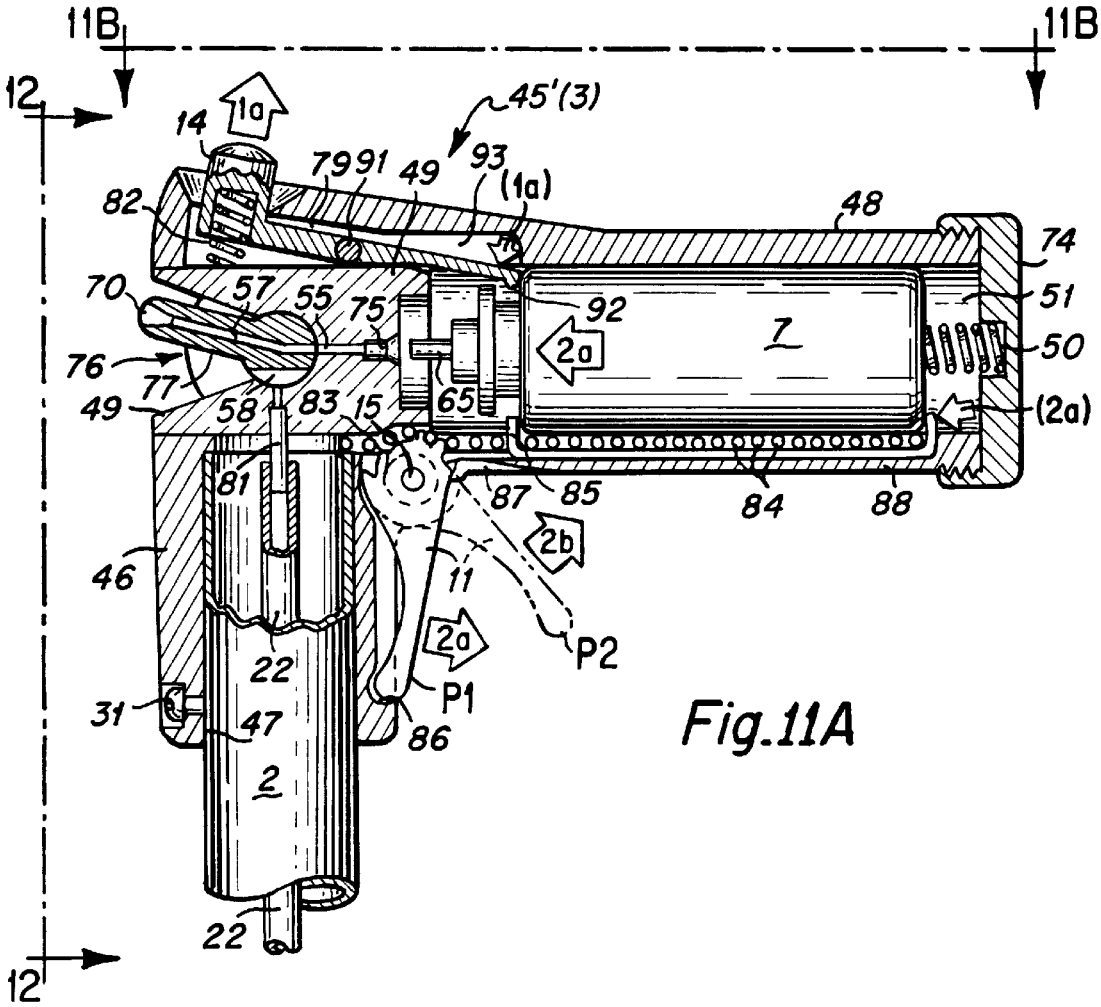
FIGS. 11A through 11B, 12 and 13 are a series of related figures showing a third embodiment of the L-handle pepper spray security cane of the invention.

FIG. 2 through 6 show in side and transverse section the first embodiment of the invention wherein the pepper spray is actuated by a trigger collar assembly 5 interposed between the handle 3 and leg 2. FIGS. 7 through 9 show the base end of the cane leg 2 which houses the pepper spray canister 7. Note FIGS. 1–9 show a $1^{st}$ sleeve embodiment with remote canister; FIGS. 10A, B show a $2^{nd}$ embodiment of a T-handle with integrated canister; FIGS. 11A, B, C, 12 and 13 show a $3^{rd}$ embodiment of an L-handle with integrated canister; and FIGS. 14A, B show a $4^{th}$ embodiment of a T-handle with integrated canister. Common to all embodiments, handles 3, 45, 45' include a recess or socket portion 47 which receivingly engages tubular leg 2.

Turning now to the First Embodiment of FIGS. 2A–2C and 3A–3C, the sleeve trigger assembly 5 comprises a tubular sleeve 10 having a slot 30 therein which matches a slot 35 in the cane tube 2 for receiving a trigger 11 which is journaled on pin 15. The sleeve also has a round hole 40 for receiving the lock release button 14. The sleeve 5 is conveniently fastened to the cane 2 by rivets or screws 31.

Figure 2A:
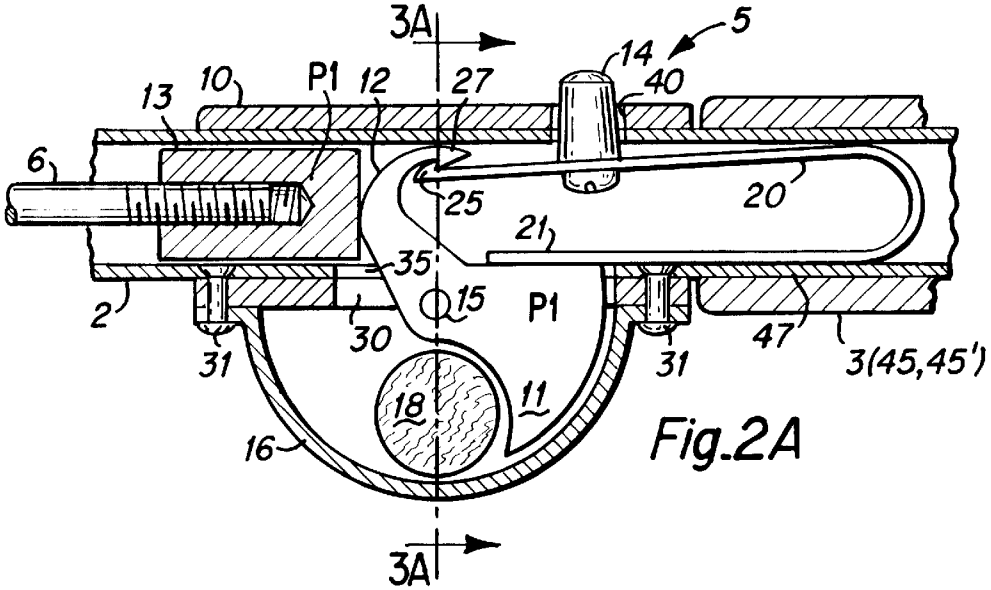
FIGS. 2A through 2C are side elevation section views through the trigger assembly showing the release of the safety catch and actuation of the spray canister by pressing the trigger.
Figure 2B:
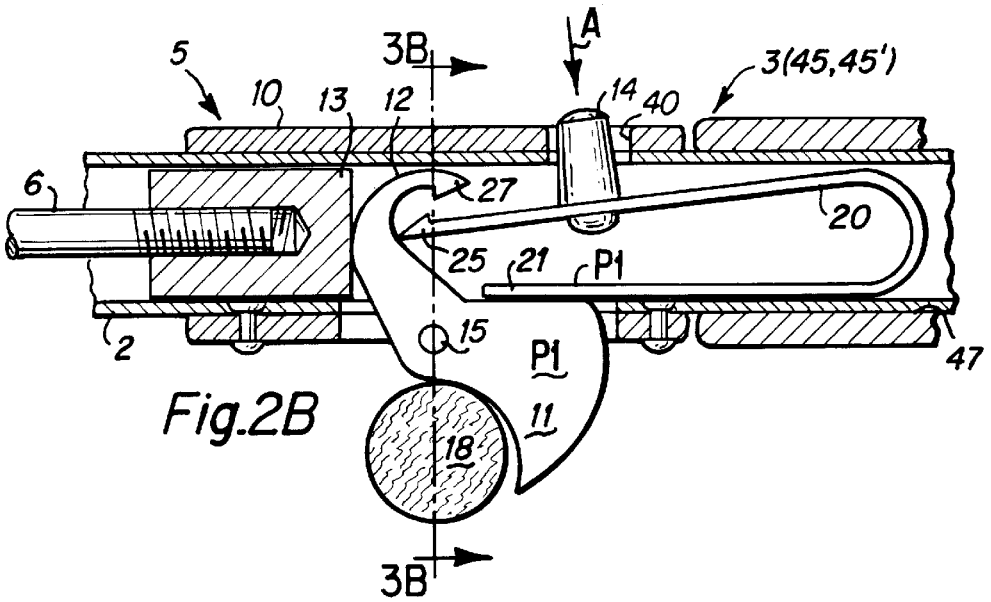

When the lock button 14 is pushed down as shown by arrow A in FIG. 2B, it presses downwardly on hairpin (u-shaped) spring 20, releasing the catch 25 of the trigger spring 20 and catch 27 of trigger 11. See the pregression form FIG 2A to 2B. The trigger 11 can then be rotated by finger 18, arrows B, C of FIG. 2C, in the normal action of a trigger. See the pregression of FIG. 2B to FIG. 2C. The camming surface 12 of trigger 11 pushes against the upper end of plug 13 which is threaded on the upper end of the actuator rod 6 (see Arrow D). At the same time, the bottom of the spring 21 moves from position P-1 (FIG. 2B), upwardly to position P-3 (FIG. 2C), which prevents the button 14 from moving downwardly any further. Spring end 21 thus acts as a stop in position P-3. FIG. 2A shows position P-1 in FIG. 2A to position P-2 in FIG. 2C. This stroke (plug movement P1 to P2) is typically 5/32", and the actuator rod 6 moves the same amount, arrow E in FIG. 2C. This is enough to actuate the aerosol canister 7 releasing spray out tip 65 and nozzle 70 (FIG. 7). The upper portion of the spring 20 and the button 14 move from position shown in FIG 2A to FIG. 2B, and back , as seen in FIG. 2C.

Thus the action is that the lock button 14 must be pushed downward to release the trigger, in which case it can be actuated to move the rod to the left. Upon release of trigger 11, the spring 20 automatically resets the trigger and catch 25 to position 1 (FIG. 2A) retained by catch 27.

Figure 3A:
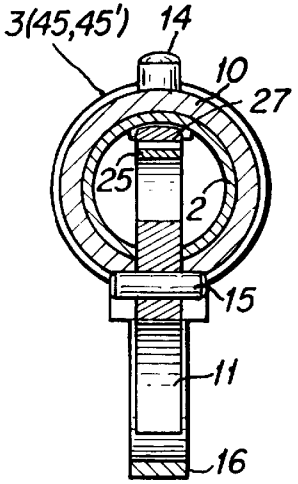
FIGS. 3A through 3C are transverse section views corresponding to FIGS. 2A through 2C showing, in progression, the movement of the trigger and the actuation spring.
Figure 2C:
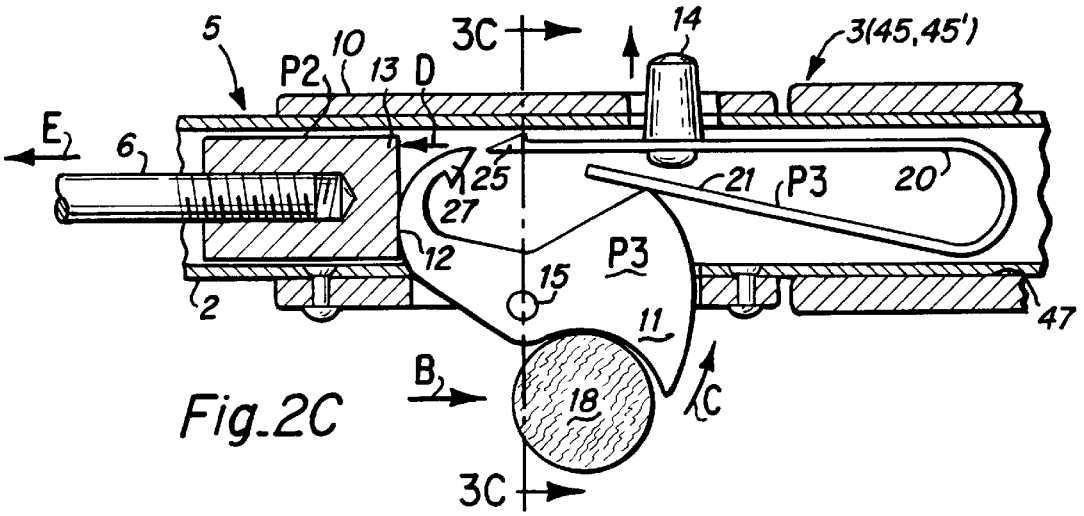
Figure 3B:
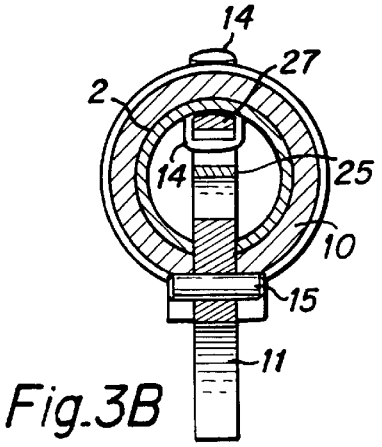
Figure 3C:
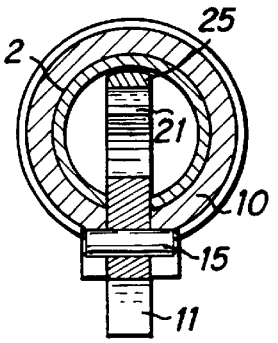

FIGS. 3A to 3C are a progressive series of transverse section views taken along lines A—A, B—B, and C—C in FIGS. 2A to 2C respectively, and show disengagement of the two catches, 25, 27 upon release of the safety button 14 (FIGS. 3A to 3B) and rotation of trigger 11 on its pin 15 (FIGS 3B to 3C). The trigger guard is 16 in FIGS. 2A and 3A.

Figure 4:
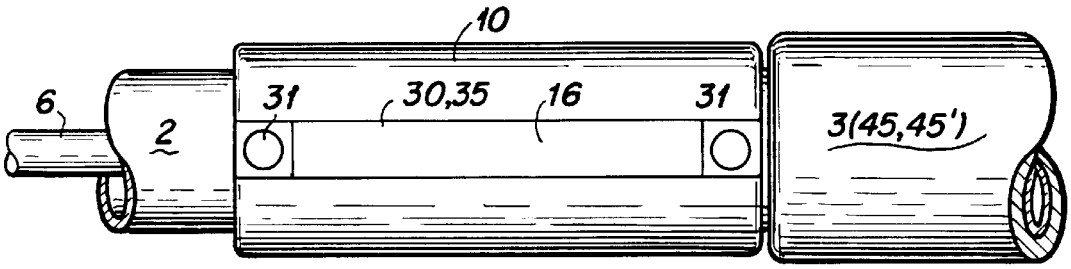
FIGS. 4 through 6 are a related series of bottom elevation views corresponding to FIG. 2A showing the trigger slot in the cane leg trigger assembly and the trigger guard respectively.

FIG. 4 is a bottom elevation showing the fastening of the trigger guard 16 over trigger 11, slot 30 in the sleeve 10 and slot 35 in tube 2. FIG. 5 the sleeve is removed showing slot 35 in tube 2 and the safety button hole 40. FIG. 6 shows the trigger 11 mounted in the sleeve 10 on tube 2.

Looking at FIGS. 7 through 9, the base end of the actuator rod 6 has threaded thereon an end plug 60 which contacts the bottom of the pepper spray canister 7. The tip of the pepper spray canister 65 fits in the recess 75 of the aerosol nozzle 70 which in turn fits in a bore 80 in the cane tip 4. In actual practice, the tip 65 fits in the receiving channel 75 so that when the plug 60 pushes on the base of the canister 7, spray exits out the nozzle aperture 9. That is, in actual practice, the tip 65 is fully seated in the bore 75.

In use, according to FIG. 1B, the disabled person raises the cane, points it at the assailant or the dog, presses the release button 14 and actuates the trigger 11.

Figure 10B:
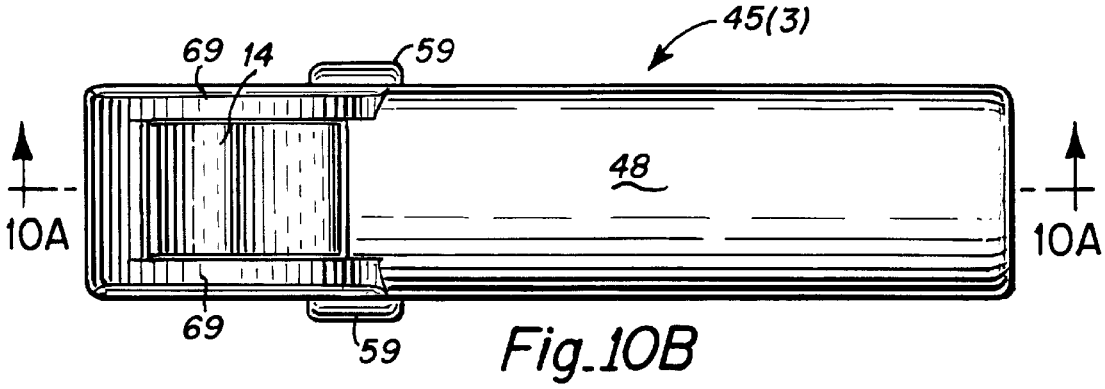

The second embodiment is shown in FIGS. 10A and 10B, comprising a T-shaped handle assembly 45 having a stem 46 with a recess or socket 47 for receiving the leg 2 of the cane or walker. The stem 46 is joined to a hollow, tubular handle section 48 which receives a pepper spray canister 7, retained against a nozzle actuator 49 by spring 50. The nozzle actuator 49 is generally cylindrical and can be removed out the front (left) of the handle section bore 51 by lifting up the release 14 and totaling the trigger 11 down (counter clockwise). Lifting release 14 disengages the disassembly catch 52 from the recess 53 in actuator 49.

The nozzle actuator 49 includes a bore 55 which communicates between the tip 65 of canister 7 and the outlet nozzle 70 to release and direct pepper spray 8. Medial of the passage 56 is a rotatable valve 56 having a main passage 57 and a diverter passage or slot 58. This valve is a cross rod extending to and engageable by ribbed knobs 59 totally received in the sides of housing 48 (see FIG. 10B). When rotated to a first position (e.g. horizontally) channel 57 connects with 55 and spray is directed forward. When turned 90° (e.g. down) the diverter passage connects canister tip 65 to delivery tube 22 which extends down leg 2 of the cane and delivers spray our the tip 4 via nozzle assembly 70 and nozzle 9 (see FIGS. 7–9).

The rear catch 61 of safety release 14 sits in a trapezoidal recess 62 of actuator 49 preventing the slidable actuator/ nozzle assembly 49 from sliding to the right (in FIG. 10A). To actuate the spray, the safety 14 is pressed down with the thumb in depression 63. This causes the arm 71 to flex upward at web 66 when fulcrum 64 touches the top surface of member 49, and knob 61 is lifted out of recess 62. Then, by pressing up on the trigger 11 (arrow F), the trigger pivots clockwise on pin 15 from position P1 to the position P3 shown in dashed lines. Actuator knob 67 is received in lower recess 68. As the trigger is pulled up, the knob 67 causes the actuator/nozzle block 49 to slide to the right releasing spray from the canister.

Wings 69 on either side of the safety 14 prevent accidental release of the catches 52 and 61. Hole 72 in the end of housing 48 permits insertion of a push rod (e.g. a pencil) to assist in removal of the canister 7. Also the silver or other color of the canister bottom is visible through the hole letting the user know the cane is loaded. Conveniently, a red or green spot 73 can be painted on the can for positive ID of the loaded condition through the hole 72.

FIGS. 11A–C, 12 and 13 illustrate a third embodiment; an L-shaped handle assembly 45', having a horizontal handle portion 48 secured to a stern portion 46 having a recess 47 into which the leg 2 is secured by screw 31. The horizontal handle end is tubular, and contains bore 51 into which the pepper spray canister 7 is received, and urged against nozzle/actuator block 49 by means of spring 50 which is secured in position by screw-on end cap 74. The tip 65 of the canister 7 is received in recess 75 in block 49, and it communicates via passageway 55 to a combined nozzle valve assembly 77. This assembly 77 comprises a stem having a ball on one end and a T-shaped directional lever 78 at the other end. Bore 57 passes through the center of the ball and the stem, and exits on the outer end in nozzle 70. The ball also includes a diverter slot 58 which functions as described above for the second embodiment. That is, when the lever handle 78 is pushed in the downward position, gas can be diverted from passage 55 through diverter 58 to the connector 81, and then to the tube 22 for delivery of gas out the cane tip 4 as described above.

The trigger 11 is rotatably mounted on pin 15 in a shoulder at the inner juncture of the tubular handle 48 and the stem 46. In its normal, non-spray condition, the handle end is in the P1, as shown in FIG 11A with the end of the handle received in the recess 86 in the stem 46. The upper end of the trigger handle includes gear teeth 83 extending through 87 in handle 48 to engage a plastic track 84. The track 84 engages and retains a u-shaped slidable bracket 85 which in turn cradles the cartridge 7.

In operation, the safety lock 14 is normally in the up position, arrow 1*a* as shown in FIG. 11A, urged in that position by spring 82 which rests against the top surface of block 49. In this position the lock lever 79, pivoted on pin 91 has its aft tip 92 in a downward position, which tip 92 engages the forward shoulder of the canister 7 preventing it from moving to the left to release pepper spray. When the button 14 is pushed downward as seen in FIG. 11C, the tip 92 rides up over the edge of the canister shoulder as shown by arrow 1*b* and the cansiter moves to the left as shown by arrow 2*c* urged in that direction by the spring 50 (see FIG. 11A). This motion also causes the bracket 85 to move to the left, and in turn automatically disengages the trigger 11 from the position P1 in FIG. 11A and arrow 2*b*, 2*c* in FIG. 11C. This moves the lever to the position P3 as shown in FIG. 11C. When this occurs, the nozzle of the canister 65 is pressed against the bottom of the recess 75 and gas is released. Once the spray has been released, the trigger can be returned to the position P1 shown in FIG. 11A and the gear track 84, being bi-acting, returns the canister to the rightward-most position compressing spring 50. The spring 82 returns the stop end 92 of the lock release level 79 to the position shown in FIG. 11A to engage the forward-most shoulder of the canister 7, returning the entire assembly to the safety lock position.

Figure 11B:
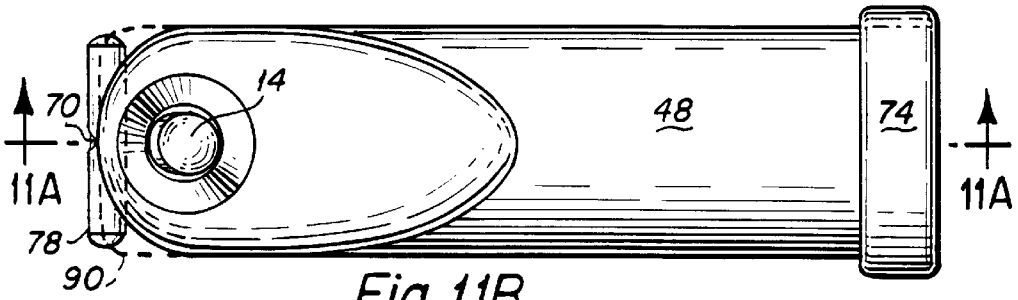
Figure 11C:
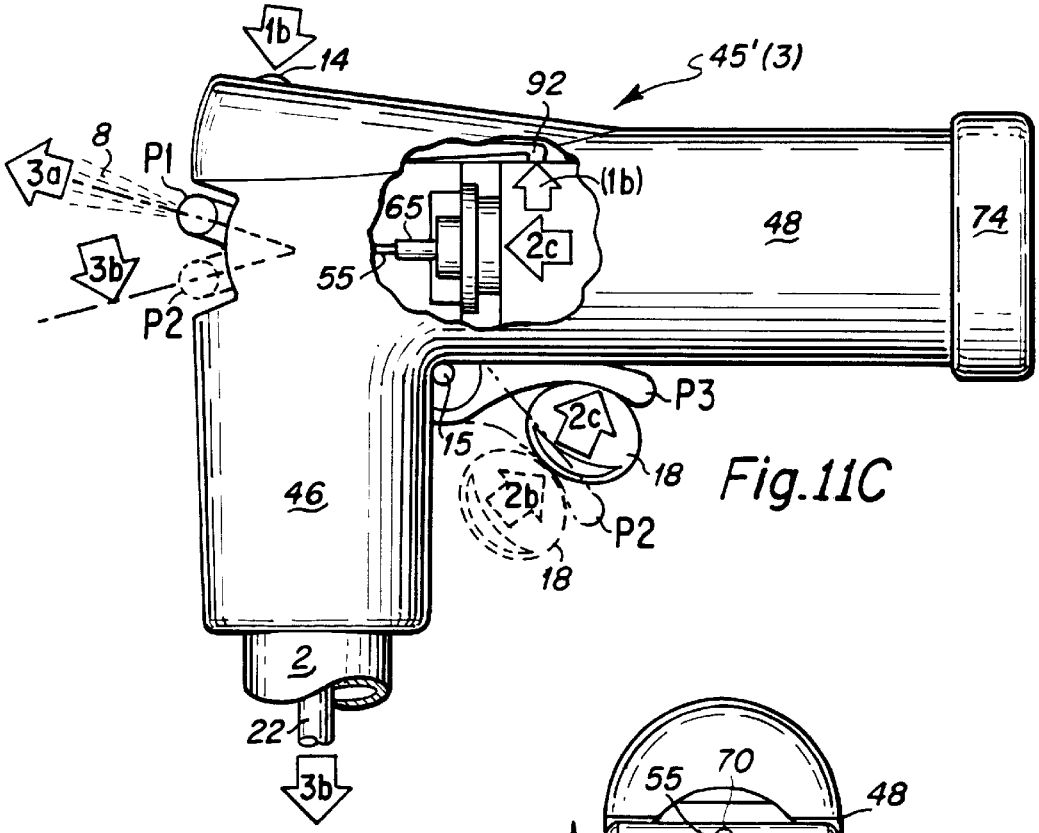
FIG. 11C is a side elevation partly in section of the third embodiment of FIG. 11A in the spray mode.
Figure 12:
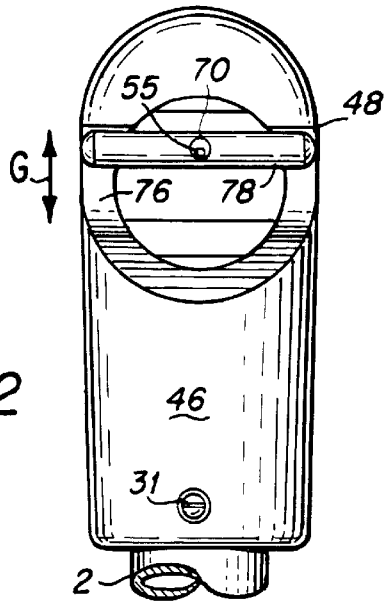

FIG. 11B shows a top plan view of the assembly shown in FIG. 11A. This more clearly illustrates the T-shaped directional level 78 on the forward end of the nozzle valve assembly 77. Likewise, FIG. 12 is a front elevation showing that the nozzle 70, by means of the T-shaped handle portion 78 can be adjusted from the upward handle spray position as shown in FIG. 11A (also see P1 in FIG. 11C), to a lower, diverted position P2 as shown in FIG. 11C (also see arrow G in FIG. 12 and arrow 3B in FIG. 11C). When the handle 78 is in the downward position P2, as best seen in FIG. 11C, note that the spray is delivered down the tube 22 as shown by the arrow 3*b* at the bottom of the figure.

Figure 13:
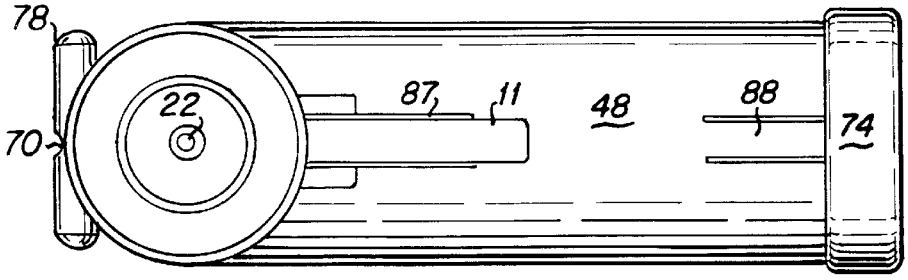

FIG. 13 is a bottom plan view showing the trigger 11 in the P3 position of FIG. 11C. The tang 88 assists in retaining the cap 74 and also in insertion and removal of the plastic ladder chain 84 and bracket 85. Note also in FIG. 11B that the front of the tubular handle 48 can have the alternative profile identified with the dashed line 90. This alternative profile tends to protect the ends of the T-shaped handle 78 so that it is not accidentally snagged in clothing diverting it from a preferred position.

Figure 14A:
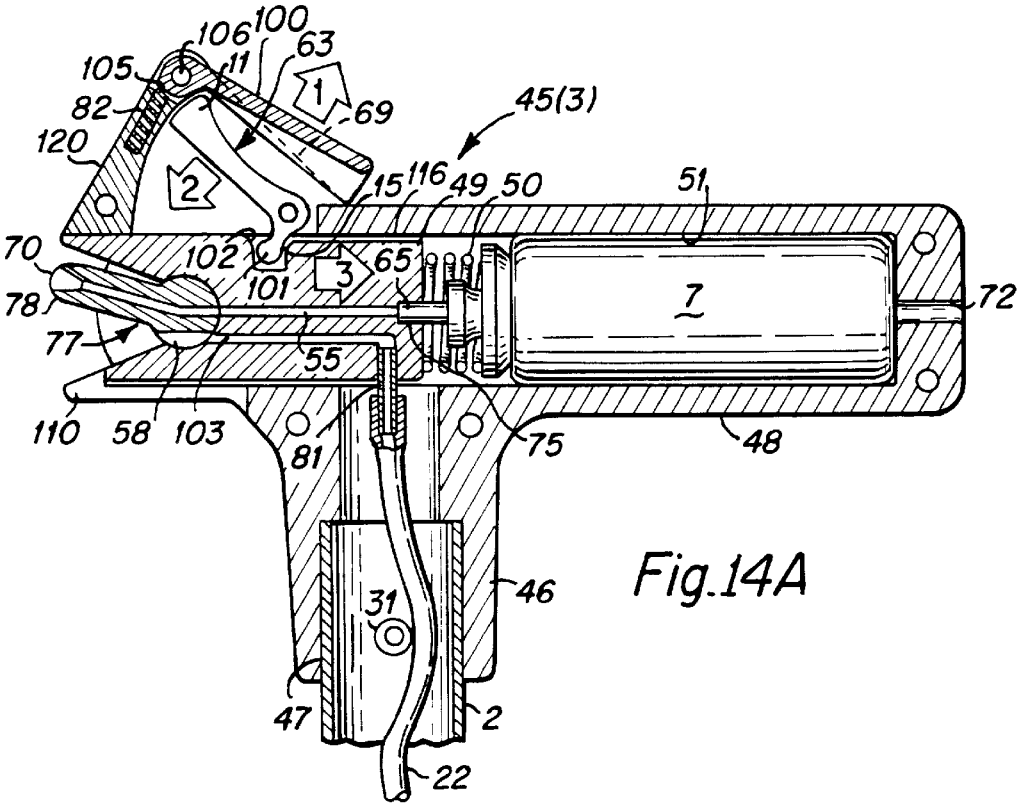
FIGS. 14A and 14B are related views of a fourth embodiment showing a T-shaped hollow handle containing the pepper spray canister mountable on the top of a standard cane or walker leg, with FIG. 14A being a side section view and FIG. 14B being a top view, this embodiment illustrating a design of a protective housing over the safety lock.

FIGS. 14A and B show a fourth embodiment, comprising a T-shaped handle 45 having a generally horizontal tubular handle 48 to which is secured a stem 46 having a recess 47 for receiving the hollow leg tube 2 which is secured by screws or rivets 31. As before, the canister 7 fits in the bore 51 and is retained in position by spring 50 which gears against the slidable block 49. The tip of the canister 65 fits in the recess 75, and spray is directed out the bore 55 through the nozzle valve assembly 77 and out the nozzle 70. As in the 3$^{rd}$ embodiment of FIGS. 11A and 11C there is also a diverter channel 58, which, when the nozzle is in the down position (see P2 in FIG. 11C),the gas is diverted to pass through channel 103, and connect with the down tube 22 via the union 81.

To activate the assembly, the safety lid 100 is lifted as shown by arrow 1. It is biased in the down position by spring 82 bearing on the cam surface 105 forward of the safety lid pivot 106. Then, the trigger 11 is pressed downwardly, causing the elbow, 101, engaged in the notch 102 of the block 49 to press backward against the force of spring 50 ejecting the spray. The downward pressure on trigger 11 is shown by the large arrow 2. Once this pressure by the thumb bearing on the depression 63 of the trigger 11 is relieved, the spring 50 forces the block backward and the trigger returns to the "up" position. Likewise, the compression spring 82 forces the safety cover 100 back to its closed position. The tang 110 is formed by two spaced vertical slots leaving a springy finger (much like finger 88 in FIG. 13). To remove the block 49 and replace canister 7, the tang 110 is pulled downwardly and the block 49 slides out. The rear chamber 115 permits the elbow 101 to clear as the lever is then pushed into almost a vertical position. The knob 101 rides in the groove 116 until the entire block can be removed and the canister tapped out or pushed out through the rear hole 72.

Figure 14B:
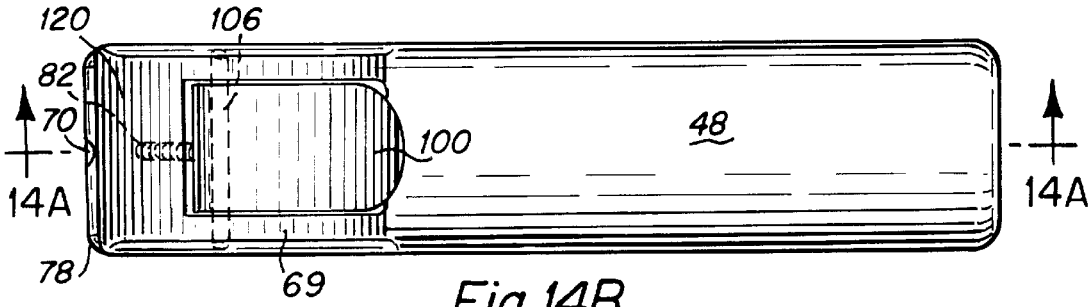

FIG. 14B is a top plan view showing the safety cover 100 journal in the generally triangular forward housing 120.

It should be understood that various modification within the scope of this invention can be made by one of ordinary skill in the art without departing from the spirit thereof. I therefore wish my invention to be defined by the scope of the appended claims as broadly as the prior art will permit, and in view of the specification if need be.

I claim:

1. A security walking assist device comprising in operative combination:

a) a handle member;

b) at least one vertical leg attached to said handle member at a first end and having an anti-slip member at a second end of said leg;

c) a self-defense protective spray canister disposed in either said handle or said leg; and d) protective spray triggering assembly which includes a trigger pivotally disposed in association with said handle for single-hand operation by a user for release of protective spray from said canister while said user's hand retains its grip on said handle.

2. A security walking assist device as in claim 1 wherein said trigger assembly includes a sleeve disposed adjacent the juncture of said leg and said handle, said trigger is pivotally mounted in said sleeve, and means actuable by said trigger to engage said self-defense protective spray canister to permit release of spray from said canister upon actuation of said trigger.

3. A security walking assist device as in claim 2 wherein said sleeve includes a reciprocating safety lock member actuable to release said trigger.

4. A security walking assist device as in claim 3 wherein said self-defense spray canister is located adjacent the second end of said leg, and which trigger assembly includes a reciprocal actuator rod assembly disposed between said trigger and said canister to urge said canister into a spray release position upon actuation of said trigger, and which said second end includes a nozzle to permit release of said spray upon actuation of said trigger when said device is raised and pointed.

5. A security walking assist device as in claim 4 which includes a U-shaped spring having a catch at one end of one of the legs of said spring which engages a tang on said trigger, said safety comprising a member which engages the spring to release the spring catch from said trigger catch, permitting said trigger to actuate said actuator rod mechanism.

6. A security walking assist device as in claim 1 wherein said handle member includes a substantially straight portion, and a socket portion disposed on one side of said straight portion into which said leg is received and attached, said straight handle portion comprises a hollow tube having a bore for receiving said self-defense protective spray canister, and which hollow handle portion includes a spray actuator and nozzle assembly; and said trigger assembly is disposed associated with said handle to actuate said spray canister to release said spray upon said single-handed actuation by a user.

7. A security walking assist device as in claim 6 wherein said trigger assembly is disposed in said handle at the forward juncture of said socket portion and said handle straight portion.

8. A security walking assist device as in claim 7 wherein said handle includes a safety lock member that is single-finger actuable to release said trigger.

9. A security walking assist device as in claim 7 wherein a safety release is disposed on the top forward end of said handle, and said trigger is disposed at the lower juncture of said handle straight portion and said socket portion.

10. A security walking assist device as in claim 7 wherein said handle straight portion includes a spring interposed between said nozzle/actuator assembly and said spray canister, said nozzle/actuator assembly is reciprocable in said handle bore, said trigger includes an actuator knob member engageable in a recess in said nozzle/actuator assembly so that upon upward rotation of said trigger said nozzle/actuator assembly is moved into contact with said cannister to release spray therefrom, and which spring returns said nozzle/actuator assembly to a stop spray position upon release of pressure on said trigger.

11. A security walking assist device as in claim 6 wherein said trigger is disposed in said handle at the rear juncture of said socket portion and said handle straight portion.

12. A security walking assist device as in claim 8 wherein said trigger includes a safety lock and release mechanism.

13. A security walking assist device as in claim 12 wherein said safety release is disposed on the top forward end of said handle, and said trigger is disposed at the lower juncture of said handle straight portion and said socket portion.

14. A security walking assist device as in claim 6 wherein said trigger is disposed in said handle at an upper forward surface of said handle straight portion.

15. A security walking assist device as in claim 14 wherein said trigger is disposed pivotally journaled in the top of said handle, and includes a pivotable cover over said trigger, which cover is raisable to access said trigger for actuation.

16. A security walking assist device as in claim 6 wherein said actuator and nozzle assembly includes a movable nozzle which is directed forward of a front of the device, and which in a first, upward position permits spray to exit forward of said hollow handle, and in a second, bypass position directs spray down a tube from the handle to the base of said leg, and which device leg includes a nozzle at said second end through which said spray is directable by said actuator/nozzle assembly in said bypass position.

17. A security walking assist device as in claim 6 wherein said handle straight portion includes a screw-on cap for access to the tubular bore thereof for insertion and removal of the pepper spray canister.

18. A security walking assist device as in claim 17 wherein the aft, butt end of said handle straight portion includes an aperture which permits viewing whether or not a canister is loaded in said handle bore.

19. A security walking assist device as in claim 6 wherein said canister is slidably disposed in a bracket, and which trigger is pivotable and has an elongated handle at one end and gear teeth at a second end, said gear teeth engaging a ladder chain which in turn engages said bracket so that upon actuation of said trigger, said canister is moved to engage said nozzle/actuator assembly for release of spray, or disengaged therefrom to stop release of spray.

20. A security walking assist device as in claim 6 wherein said handle straight portion includes:

i) a spring urging said spray canister towards said nozzle/actuator assembly; and ii) a pivotable safety lock having a tip member which engages a forward shoulder of said canister preventing said canister, under force of said spring from moving into engagement with said nozzle/actuator assembly, and which upon release permits said canister to move forward and be engaged with said nozzle/actuator assembly for release of spray therefrom.

* * * * *